US006644980B2

(12) United States Patent
Kameda

(10) Patent No.: US 6,644,980 B2
(45) Date of Patent: Nov. 11, 2003

(54) CONNECTOR STRUCTURE, FEMALE CONNECTOR, AND MALE CONNECTOR

(75) Inventor: Yasutoshi Kameda, Ichihara (JP)

(73) Assignee: FCI, Courbevoie (FR)

( * ) Notice: Subject to any disclaimer, the term of this patent is extended or adjusted under 35 U.S.C. 154(b) by 0 days.

(21) Appl. No.: 09/951,956

(22) Filed: Sep. 13, 2001

(65) Prior Publication Data

US 2002/0098722 A1 Jul. 25, 2002

(30) Foreign Application Priority Data

Sep. 13, 2000 (JP) ..... 2000-278632

(51) Int. Cl.[7] ..... H01R 13/432
(52) U.S. Cl. ..... 439/65; 439/636; 439/83
(58) Field of Search ..... 439/65, 31, 287, 439/374, 660, 79, 74, 83, 636

(56) References Cited

U.S. PATENT DOCUMENTS 4,877,409 A * 10/1989 Tanigawa et al. ..... 439/31
5,176,528 A 1/1993 Fry et al. ..... 439/181
5,466,171 A 11/1995 Bixler et al. ..... 439/378
5,551,883 A * 9/1996 Davis ..... 439/65
6,068,494 A * 5/2000 Tokuwa ..... 439/79
6,350,154 B1 * 2/2002 Fu ..... 439/638
6,375,478 B1 * 4/2002 Kikuchi ..... 439/79

FOREIGN PATENT DOCUMENTS

EP 1 026 786 A 8/2000

* cited by examiner

*Primary Examiner*—Alexander Gilman
(74) *Attorney, Agent, or Firm*—Woodcock Washburn LLP

(57) ABSTRACT

Problem to be Solved

Allowing mounting of a hard disc drive on a substrate without useless open space remaining on the substrate, and allowing miniaturization of the substrate.
Means to Solve the Problem A connector structure providing a female connector 10 fixed to a substrate B and a male connector 20 provided on a hard disc drive D to be mounted on the substrate B, wherein grooves 12 that open continuously on the upper surface 11*b* and the side surface 11*c* thereof are provided formed substantially perpendicular to said substrate B on the female connector 10, and at the same time, female contacts 13 are provided inside these grooves 12, male contacts 22 that engage the female contacts 13 are provided so as to protrude sideways from the hard disc drive D, the hard disc drive D is brought into contact to the substrate from above, and by this process, the male contacts 22 are inserted into the grooves 12 and engages with the female contacts 13.

14 Claims, 7 Drawing Sheets

CONNECTOR STRUCTURE, FEMALE CONNECTOR, AND MALE CONNECTOR

TECHNICAL FIELD OF THE INVENTION

The present invention relates to a connector structure, a female connector, and a male connector for internal mounting for implementing the connection between, for example, a substrate and a peripheral device that is directly disposed on this substrate.

CONVENTIONAL TECHNOLOGY

Recently, in the field of personal computers (below, abbreviated PC), miniaturization is rapidly progressing, and PCs have appeared that use a structure in which peripheral devices are mounted on the substrate called the motherboard provided internally. For example, in a note-type PC that emphasizes portability, the hard disc drive that serves as the main memory device is mounted on the substrate.

In mounting the hard disc drive on the substrate, as shown in FIG. 7, first the hard disc drive d is placed on the substrate b such that the female connector 1 on the substrate b is opposite to the male connector 2 of the hard disc drive d, and then the hard disc drive d is slid on the substrate b, and the male contacts 3 of the male connector 2 are connected by insertion into the female contacts 4 of the female connector 1. This type of method of engagement originates in the shape of the male and female connectors since the female connector 1 can receive the insertion of the male connector 2 only in a direction parallel to the substrate b.

PROBLEMS TO BE SOLVED BY THE INVENTION

In the case of the connecting the female and male connectors described above, because the hard disc drive is moved by sliding over the substrate, a space for moving on the substrate must be maintained so that the movement is not hindered. This space must naturally be larger than the size of the hard disc drive, and thus as a result an open space corresponding to the length of the movement remains on the substrate after the mounting of the hard disc drive. After mounting this hard disc drive, this open space has no significance, and this is a large problem when implementing miniaturization of the personal.

In consideration of the above-described problems, it is an object of the present invention to provide a connector structure, female connector, and male connector, that allows miniaturization of the PC by allowing mounting of the hard disc drive on the substrate without producing an unused open space on the substrate Specifically, a connector structure according to the claim 1 comprises a female connector having female contacts and a male connector having male contacts that engage said female contacts, wherein:

grooves are formed substantially perpendicular to the bottom of said female connector on the side surface of said female connector and said female contacts are provided inside said grooves; and said male connector is brought into proximity to said female connector from said substantially perpendicular direction, and by this process a state of contact between both contacts is attained by inserting said male contacts into said grooves and engaging said female contacts.

In the connector structure according to claim 1, a connector structure according to claim 2 is characterized in that said female connector is fixed either to the installation surface or the object to be installed on said installation surface, and said male connector is fixed on the other.

In the connector structure according to claim 2, a connector structure according to claim 3 is characterized in that said installation surface is one of the surfaces of the substrate, and said object is a device mounted on said substrate.

In a connector structure according to claim 2 or claim 3, a connector structure according to claim 4 is characterized in that: said female connector is fixed by bringing said bottom into contact with said installation surface; said male connector is fixed by said male contacts protruding sideways from said object; said female contact is provided in groups of two by separating them in a said substantially perpendicular direction in said groove;

one of said female contacts is disposed so as to be in closer proximity to said bottom than the other female contact and in proximity to said side surface; said male contact is provided in groups of two corresponding to said female contacts; and the other male contact corresponding to said other female contact is shorter than the other male contact corresponding to said other female contact, and is disposed by being place in proximity to the bottom of said object.

In a connector structure according to claim 1, 2, 3, or 4, a connector structure according to claim 5 is characterized in that said female contact comprises a pair of elastically deformable catches, and said male contacts are sandwiched between said catches.

In a connector structure according to claim 1, 2, 3, or 4, a connector structure according to claim 6 is characterized in that said female contact comprises an elastically deformable catch and a wall separated from and opposed to said catch, and said male contact is sandwiched between said catch and said wall.

In a connector structure according to claim 1, 2, 3, 4, or 5, a connector structure according to claim 7 is characterized in that said grooves are provided in plurality on said female connector, and said male connectors correspond to the plurality of said grooves, and a plurality of male contacts are provided.

In a connector structure according to claim 1, 2, 3, 4, 5, 6, or 7, a connector structure according to claim 8 is characterized in that: either a projection or recess that can be partnered is provided in said female connector;

either of the other of said projection or recess is provided on said male connector so as to fit a partner when connected to said female connector; and said projection and recess are provided shifted away from the center in the widthwise direction on both said female connector and said male connector.

In a connector structure according to claim 9, a female connector is characterized in that grooves are formed substantially perpendicular to the side surface and bottom thereof, and said female contacts are provided in said grooves.

In a female connector according to claim 9, a connector structure according to claim 1 is characterized in that said female connectors are provided in groups of two separated in said grooves in said substantially perpendicular direction inside said grooves, and one of the female contacts is disposed more in proximity to said bottom than the other female contact, and in proximity to said side surface.

A male connector according to claim 10 is characterized in that the male contacts are provided in groups of two, and one male contact is formed so as to be shorter than the other male contact.

PREFERRED EMBODIMENTS

The first embodiment of the connector structure according to the present invention will be explained referring to FIG. 1 through FIG. 5. Moreover, in the present embodiment, an example of a connector structure used when mounting a hard disc drive that is the object on the installation surface of a substrate will be explained.

Figure 1:
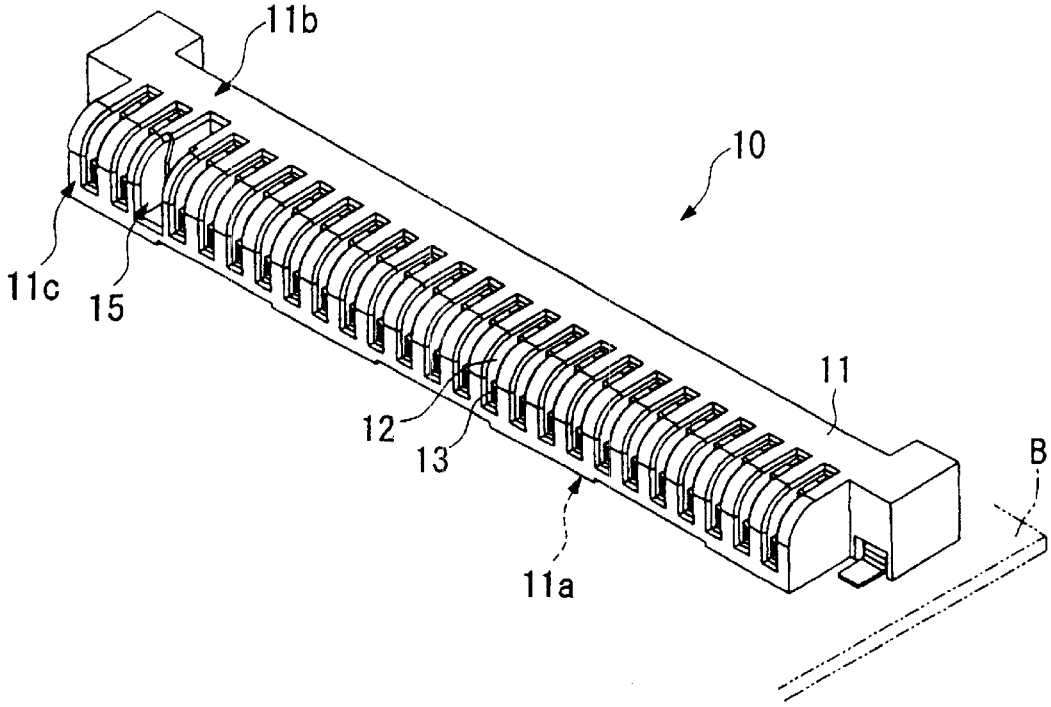
FIG. 1 is a perspective drawing showing the female connector of the first embodiment of the present invention.
Figure 2:
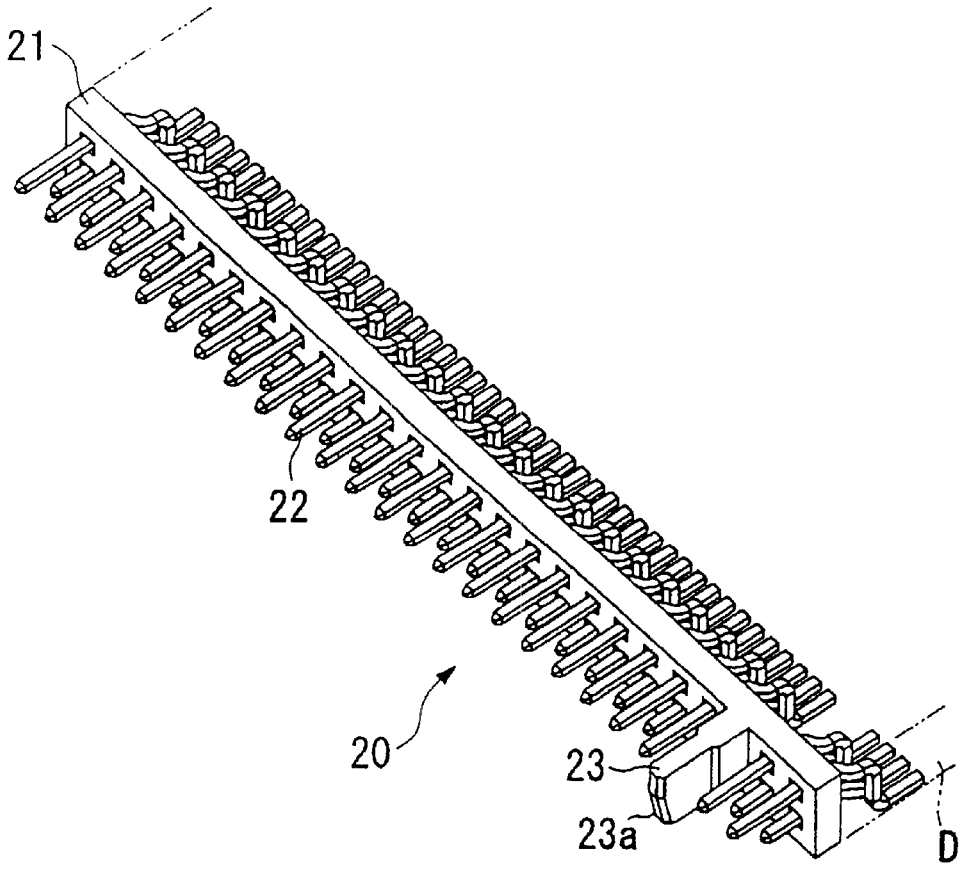
FIG. 2 is a perspective drawing showing the male connector of the first embodiment of the present invention.
Figure 3:
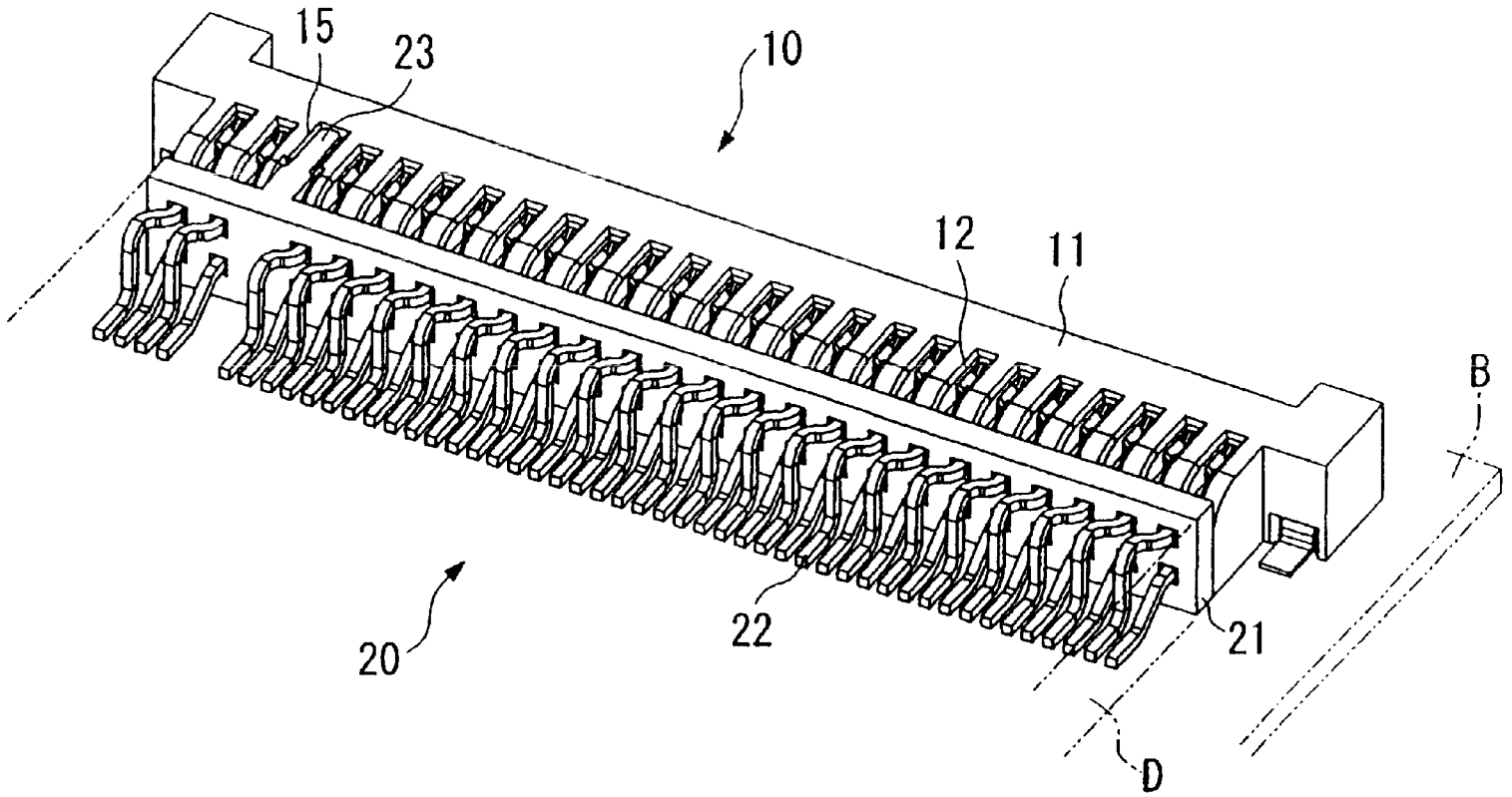
FIG. 3 is a perspective drawing showing the state in which the female connector and the male connector are connected.
Figure 4:
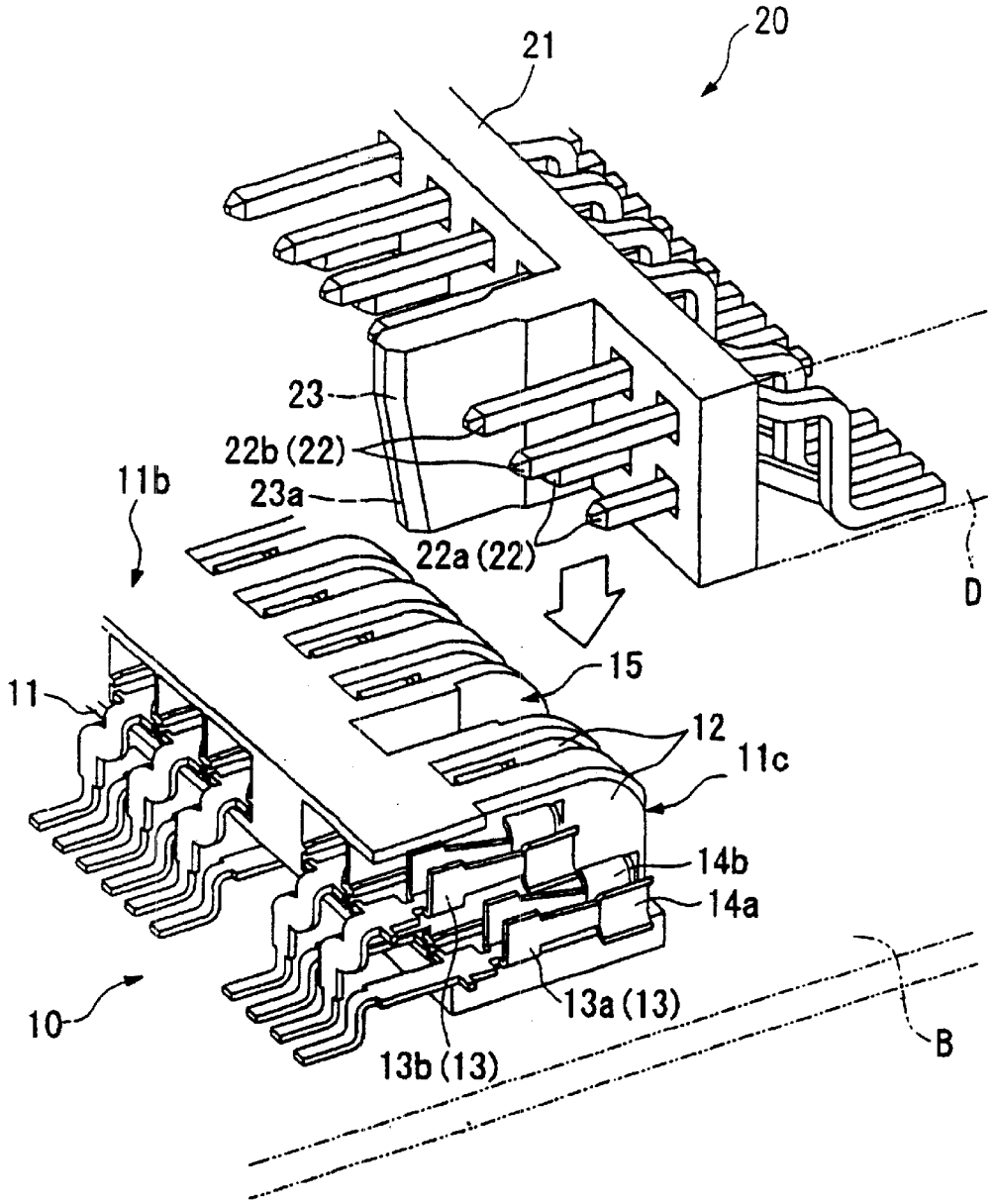
FIG. 4 is a perspective drawing showing the state in which the female connector and the male connector are opposite each other on the substrate.
Figure 5:
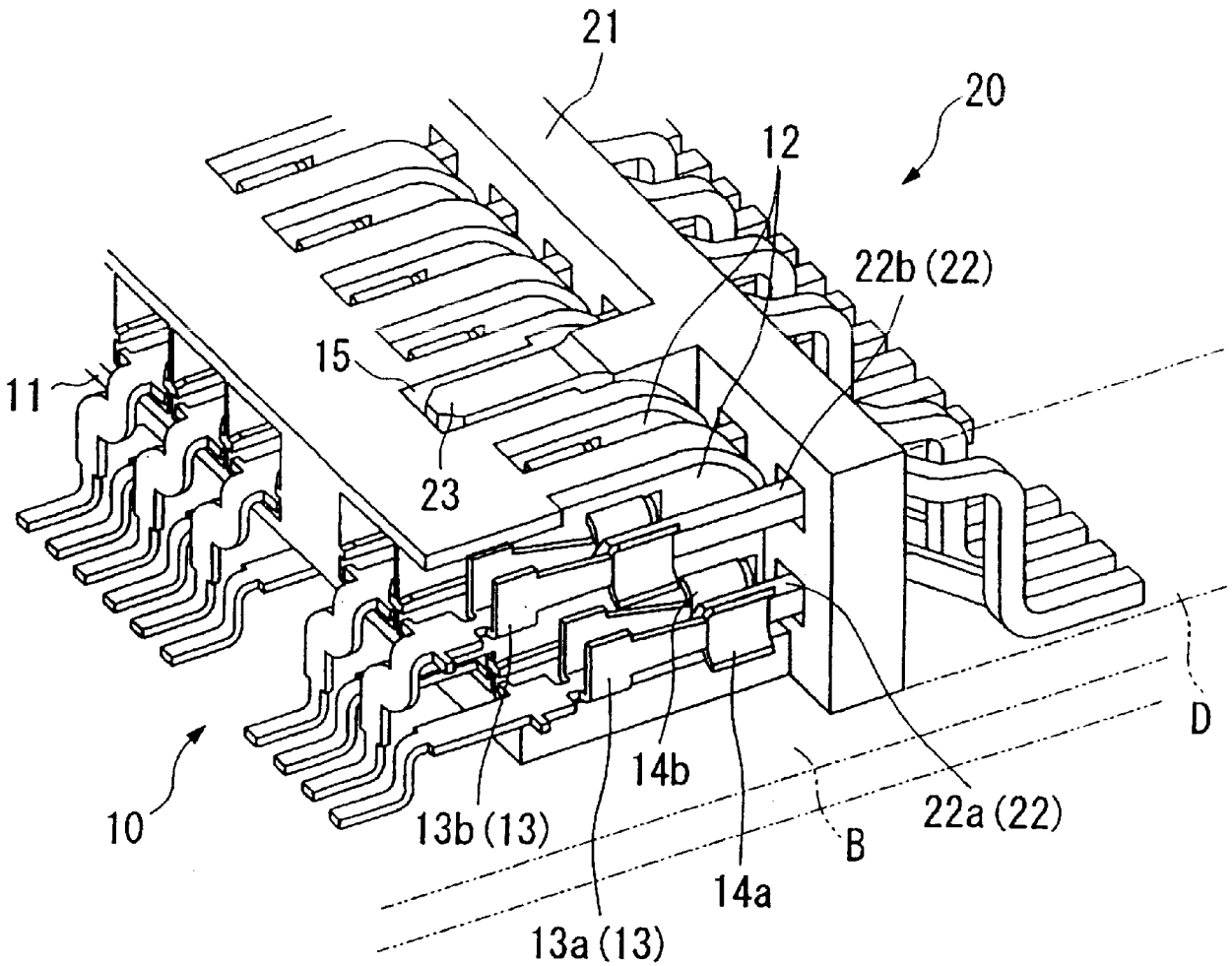
FIG. 5 is a perspective drawing showing the state in which the female connector a male connector are connected and the hard disc drive is mounted on the substrate.

FIG. 1 shows the female connector 10, FIG. 2 shows the male connector 20, and FIG. 3 shows the state in which the female connector 10 and the male connector 20 are connected. In addition, FIG. 4 shows the state in which the female connector 10 on substrate B and the male connector 20 are opposite each other, and FIG. 5 shows the state in which the female connector 10 and the male connector 20 are connected and the hard disc drive is mounted on the substrate B.

The base 11 forming the female connector 10 has a shape that is long in the lateral direction, and the lower surface 11*a* is anchored so as to lie on the substrate B. At the base 11, grooves 12 formed in a direction perpendicular to the lower surface 11*a* and opening continuously on the upper surface 11*b* and side surface 11*c* thereof are provided in plurality in parallel in the width direction of the base 11. In addition, female contacts 13 are each disposed inside all of the grooves 12 (refer to FIG. 1).

Female contacts 13 are provided in groups of two inside each of the grooves 12. The female contacts 13*a* and 13*b* that serve as one group are separated in the direction of disposition of the grooves 12, that is, in the direction perpendicular to the substrate. One of the female contacts 13*a* is more in proximity to the lower surface 11*a* than the other female contact 13*b*, and is disposed in proximity to the side surface 11*c* in which the grooves 12 open (refer to FIG. 4).

The base 21 that forms the male connector 20 has a shape that is long in the lateral direction like the female connector 10. On the base 21, holes passing from one surface to the other surface are provided parallel to the base 21 in the widthwise direction and on two vertical levels. In addition, in all of the holes, male contacts 22 are each inserted and disposed, with the distal end protruding from one side surface 21*a* and the base projecting from the other side surface. In the male connector 20 itself, the distal end of a male contact 22 protrudes from the side surface towards the hard disc drive D, and is anchored (refer to FIG. 2).

The male contact 22 form groups of two separated vertically. For the male contacts 22*a* and 22*b* that form these groups, the projection length of the one male contact 22*a* on the lower level that is in proximity to the lower surface of the hard disc drive D and corresponds to the female contact 13*a* is formed shorter from the side surface 21*a* than the other male contact 22*b* corresponding to the female contact 13*b* (refer to FIG. 5).

The female contact 13 is formed by stamping and bending processing a metal material having superior conductivity into a predetermined shape, and has a pair of catches 14*a* and 14*b* that are elastically deformable. The distal ends of the catches 14*a* and 14*b* have an arc-shaped cross-section, and are disposed so that the projecting surfaces oppose each other. The separation between the catches 14*a* and 14*b* is set so as to be narrower than the thickness of the distal end of the male contact 22, and the female contact and male contacts are engaged so as to allow electrical conduction by the distal end of the male contact 22 being inserted so as to be sandwiched between the catches 14*a* and 14*b*.

In all of the female contacts 13, the catches 14*a* and 14*b* are disposed separated in the widthwise direction of the base 11 so that the gap between the catches 14*a* and 14*b* in the grooves 12 passes through from the direction of disposition of the grooves 12, that is, in the direction perpendicular to the base. This is in order to allow the insertion of a male contact 22 in between the catches 14*a* and 14*b*.

In the female connector 10, at one position of the base 11 in the widthwise direction on which the grooves 12 are arranged, a recess 15 is provided so as to partition the grooves 12. This recess 15 opens continuously on the upper surface 11*b* of the base 11 to the side surface 11*c* like the grooves 12. Moreover, the recess 15 is formed at a position shifted away from the center of the base 11 in the widthwise direction.

In the male connector 20, a projection 23 is provided that fits into the recess 15 when connected with the female connector 10. This recess 23 is also formed at a position shifted away from the center of the base 21 in the widthwise direction. In addition at the distal end of the projection 23, a slanted surface 23*a* is formed so that the projection 23 can be easily guided into the recess 15.

The method of connecting both in the case of mounting a hard disc drive D providing a male connector 20 having the structure described above on the substrate B providing a female connector 10 having the structure described above will now be explained.

First, the hard disc drive D is disposed on the upper side of the substrate B (refer to FIG. 4). At this time, care is taken so that each of the male contact 22*a* and 22*b* groups are disposed directly above each of the grooves 12, and the projection 23 is positioned directly above the recess 15.

From this state, the hard disc drive D is slowly moved towards the substrate B, and the projection 23 is inserted into the recess 15 from the lower part. Subsequently, the hard disc drive D continues to be moved towards the substrate B, and the male contacts 22*a* of the lower level and the male contacts 22*b* of the upper level are inserted in sequence into the grooves 12 (refer to FIG. 5). Moreover, this operation must progress simultaneously and continuously for the male contacts 22*a* and 22*b* corresponding respectively to all of the grooves 12.

The distal ends of the male contacts 22*a* and 22*b* inserted into the grooves 12 substantially simultaneously abut the distal ends of the catches 14*a* and 14*b* of each of the corresponding female contacts 13*a* and 13*b*. Here, because the gap between the catches 14*a* and 14*b* is set so as to be narrower than the thickness of the male contacts 22*a* and 22*b*, the insertion of the male contacts 22*a* and 22*b* between the catches 14*a* and 14*b* cannot be carried out easily, and thus in the operation of moving the hard disc drive D closer to the substrate B, a resistance force occurs as long as a space exists between the substrate B and the hard disc drive D.

Thus, reacting to this resistance force, when the hard disc drive D is pressed onto the substrate B, the male contacts 22*a* and 22*b* push open the catches 14*a* and 14*b*, and enter therebetween. Thereby, the female contacts 13*a* and 13*b* and the male contacts 22*a* and 22*b* are electrically engaged. Simultaneously, the bottom surface of the hard disc drive D abuts the substrate B, and a stable positioning is guaranteed.

If the hard disc drive D is mounted on the substrate B by using the connector structure comprising the female connector 10 and the male connector 20 as in the present embodiment, the action of sliding the hard disc drive D on the substrate B does not occur, and thus providing an open space for moving the hard disc drive D on the substrate B is not necessary, and the size of the substrate B can be reduced by a corresponding amount. Thereby, the PC itself having the substrate mounted can be miniaturized.

When the female connector 10 and the male connector 20 are connected, by fitting the projection 23 on the male connector 20 side into the recess 15 on the female connector 10 side, both of the connectors 10 and 20 can be connected without a polarity error. Moreover, providing a projection on the female connector 10 and a recess on the male connector 20 attain the same effects, and are not limited by the present embodiment.

In the present invention, the case in which a hard disc drive is mounted on a substrate B was explained, but providing the male connector 20 on the substrate and the female connector 10 on the device is also possible.

In addition, the structure of the connectors of the present embodiment are not limited to a substrate and a hard disc drive, but of course by providing these respectively on two objects that are to be electrically connected, the connection can be realized Furthermore, the connector structure of the present invention can also be used as a unit.

Figure 6:
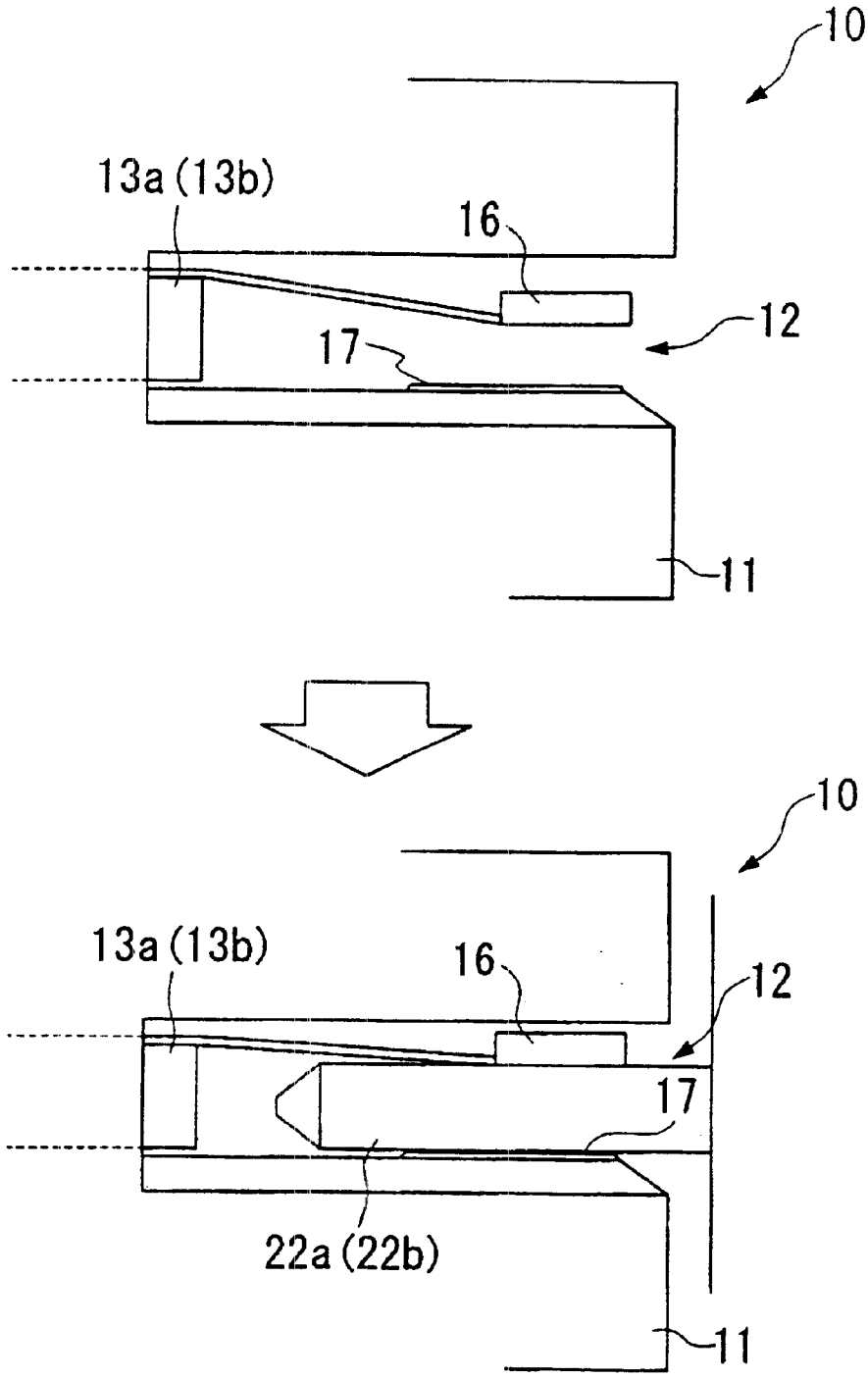
FIG. 6 is a planar drawing showing the female connector of the second embodiment of the present invention.
Figure 7:
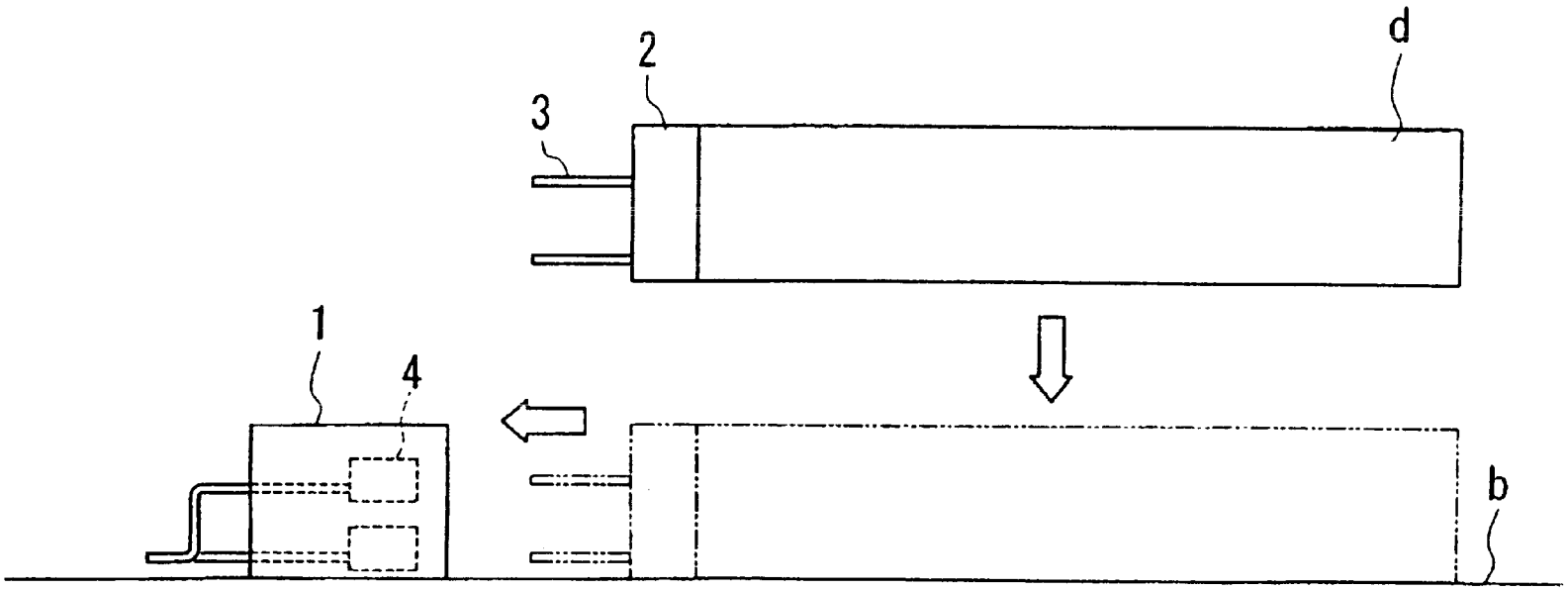
FIG. 7 is an explanatory drawing showing the process in which the hard disc drive is mounted on the substrate using the conventional connector structure.

Next, the second embodiment of the connector structure according to the present invention will be explained referring to FIG. 6. Moreover, the essential constituent elements already explained in the above described embodiment have identical reference numerals, and their explanation has been omitted.

In this embodiment, a female connector 13*a* (13*b*) is formed from an elastically deformable catch 16 formed by a metal material having superior conductivity and a wall 17 separated from and opposite to the catch 16. In this case, the wall 17 is one of the walls that form a groove 12. The gap between a catch 16 and a wall 17 is set so as to be narrower than the thickness of the distal end of a male contact 22*a* (22*b*), and the distal end of a male contact 22*a* is inserted so as to be sandwiched between the catch 16 and the wall 17, and thereby the female and male contacts are electrically engaged.

In this embodiment as well, in the case of mounting a hard disc drive D providing a male connector 20 on a substrate B providing a female connector 10, the method of their connection is basically the same as that of the first embodiment described above. In the case of the present embodiment, when the hard disc drive D is pressed to the substrate B after the distal end of the male contacts 22*a* abut the catches 17, the male contacts 22*a* deform the catches 15 and enter so as to press open the space between the catches 15 and the walls 17. Thereby, the female contacts 13 and the male contacts 22*a* are electrically engaged.

If a female connectors 10 such as those of the present embodiment are used, the shape of the female contact 13 is simple in comparison to that of the first embodiment described above, and can be completed using a small amount of material. Thus there is the advantage that the costs related to fabrication can be reduced.

EFFECTS OF THE INVENTION

As explained above, according to the present invention, on the side surface of the female connector grooves are formed in a substantially perpendicular direction with respect to the bottom surface of the female connector, and at the same time, female contacts are provided inside these grooves, the male contacts are brought into contact with the female connector from a substantially perpendicular direction, and in this process, by the male contacts being inserted into the grooves and engaging the female contacts, a state of contact between both contacts is attained. Thereby, while being connected, there is no action of sliding the hard disc drive on the substrate, as is the case conventionally, and thus an open space moving the hard disc dive on the substrate is not necessary. Thus, the substrate can be reduced by an amount corresponding to the open space, and the apparatus itself built into this substrate can be miniaturized.

What is claimed is:

1. A connector structure comprising a female connector having female contacts and a male connector having male contacts that engage said female contacts, wherein:

grooves are formed substantially perpendicular to a bottom of said female connector on a side surface of said female connector and said female contacts are provided inside said grooves; said female contact is provided in groups of two by separating them in said substantially perpendicular direction in said groove, one of said female contacts is disposed so as to be in closer proximity of said bottom than an other of said female contacts and in proximity to said side surface;

said male contact is provided in groups of two corresponding to said female contacts, whereby said male connector is brought into proximity to said female connector from said substantially perpendicular direction, and by this process a state of contact between both contacts is attained by inserting said male contacts into said grooves and engaging said female contacts.

2. A connector structure according to claim 1 wherein said female contact comprises a pair of elastically deformable catches, and said male contacts are sandwiched between said catches.

3. A connector structure according to claim 1 wherein said female contact comprises an elastically deformable catch and a wall separated from and opposed to said catch, and said male contact is sandwiched between said catch and said wall.

4. A connector structure according to claim 1 wherein said grooves are provided in plurality on said female connector, and said male connectors correspond to the plurality of said grooves, and a plurality of male contacts are provided.

5. A connector structure according to claim 1 wherein:

either a projection or recess that can be partnered is provided in said female connector;

either of the other of said projection or recess is provided on said male connector so as to fit a partner when connected to said female connector; and said projection and recess are provided shifted away from the center in the widthwise direction on both said female connector and said male connector.

6. A connector structure according to claim 1 wherein a one contact point between the one male connector and the one female connector is closer in proximity to said bottom than an other contact point between the other male connector and the other female connector.

7. A connector structure according to claim 1 wherein said female connector is fixed to one of an installation surface and an object to be installed on said installation surface, and said male connector is fixed on an other one of the installation surface and the object.

8. A connector structure according to claim 2 wherein said installation surface is one of a surface of a substrate, and said object is a device mounted on said substrate.

9. A connector structure according to claim 1 wherein each group of the two male contacts comprises one male contact corresponding to the one female contact and an other male contact corresponding to the other female contact, the one male contact being shorter than the other male contact.

10. A connector structure according to claim 9 wherein said one male contact is disposed in proximity to the bottom of said female connector relative to the other male contact.

11. A connector structure according to claim 10 wherein said bottom of said female connector is adapted for coupling to an installation surface and the male connector is adapted for coupling to an object.

12. A connector structure according to claim 11 wherein the installation surface is a substrate and the object is a disk drive.

13. A connector structure according to claim 10 wherein said bottom of said female connector is adapted for coupling to an object and the male connector is adapted for coupling to an installation surface.

14. A connector structure according to claim 13 wherein the installation substrate and the object is a disk drive.

* * * * *